United States Patent [19]

Chao

[11] Patent Number: 4,884,659

[45] Date of Patent: Dec. 5, 1989

[54] COLLAPSIBLE LADDER

[76] Inventor: Patrick Chao, 14307 Deer Ridge Drive, S.E., Calgary , Alberta, Canada, T2J 5V9

[21] Appl. No.: 277,694

[22] Filed: Nov. 30, 1988

[51] Int. Cl.[4] ..... E04C 1/383

[52] U.S. Cl. ..... 182/164; 182/41; 182/196; 182/219

[58] Field of Search ..... 182/219, 164, 163, 156, 182/196, 41

[56] References Cited

U.S. PATENT DOCUMENTS

| | | | |
|---|---|---|---|
| 277,222 | 5/1883 | Bush | 182/196 |
| 2,461,429 | 2/1949 | Larson | 182/41 |
| 2,806,562 | 9/1957 | Harman | 182/41 |
| 3,053,358 | 9/1962 | Gross | 182/164 |
| 3,295,269 | 1/1967 | Schuster | 182/41 |

*Primary Examiner*—Reinaldo P. Machado

*Attorney, Agent, or Firm*—George H. Dunsmuir

[57] ABSTRACT

A relatively simple, lighweight, portable, collapsible ladder includes a plurality of H-shaped sections pivotally interconnected end-to-end to define a flat bundle in the stored or non-use condition. The sections can be unfolded to a flat, extended conditions. In the extended condition, torsion springs cause the sides of the sections to fold inwardly to define side bars having U-shaped cross sections. By reversing the process, the ladder can readily be restored to the folded, storage condition.

6 Claims, 5 Drawing Sheets

COLLAPSIBLE LADDER

BACKGROUND TO THE INVENTION

This invention relates to a ladder and in particular to a collapsible ladder.

In general, emergency ladders of the types used as fire escapes in multi-level dwellings are rather bulky, often heavy devices which are difficult to store. Moreover, such ladders are not always readily transformed from the storage or folded condition to the extended or use condition.

The object of the present invention is to offer a solution to the above-identified problems by providing a relatively simple collapsible ladder, which is lightweight, capable of being folded to a compact storage condition, and easily unfolded to an extended or use condition.

BRIEF SUMMARY OF THE INVENTION

Accordingly, the present invention relates to a collapsible ladder comprising a plurality of panel means pivotally interconnected in end-to-end relationship to form a compact body when folded into overlapping relationship with each other and to define an elongated body when unfolded so that the panel means are end-to-end in a plane, each said panel means including substantially rigid, central, transversely extending rung means and at least one side bar means on each end of said rung means pivotally connected to said rung means and to any subjacent or superjacent side bar means for rotation between a storage position in the same plane as said rung means and a use position perpendicular to said rung means; and spring means for biasing at least one and consequently all other said side bar means to the use position, whereby, when the said panel means are unfolded, the side bar means automatically rotate to the use position.

BRIEF DESCRIPTION OF THE DRAWINGS

The invention will be described in greater detail with reference to the accompanying drawings, which illustrate a preferred embodiment of the invention, and wherein:

With reference to FIGS. 1 to 3, the ladder of the present invention includes a plurality of generally H-shaped sections generally indicated at 1, which can be folded accordian style into a stacked, storage condition (FIG. 1) or unfolded (FIG. 2) to a flat condition (not shown). In the flat condition, the sides of the sections 1 fold automatically upwardly and inwardly to define ladder side bars 2 of generally U-shaped cross section. Such side bars impart relative high strength to the ladder, even though thin aluminum is used in the construction of the sections 1.

Referring to FIGS. 4 to 6, each section 1 of the ladder is defined by a wide H-shaped panel 4, the crossbar of which defines a rung 5 of the ladder. Longitudinally extending, rectangular projections 6 alternating with grooves 8 on the rear surface of the rung 5 strengthen the structure. The sides 9 of the panel 4 define portions of the ladder side bars 2. For such purpose, generally circular lugs 10, 12 and 13 are provided at the top, bottom and outer side edges, respectively of each side 9 of the panel 4.

The lugs 10 and 12 define loops with holes 14 therethrough for receiving hinge pins (not shown) for pivotally interconnecting panels 4 in end-to-end relationship. The lugs 10 are staggered with respect to the lugs 12, so that panels 4 can be connected end-to-end with the lugs 10 and 12 of adjacent panels overlapping. As shown in FIG. 6, the lugs 10 and 12 on one panel are reversed with respect to the lugs 10′ and 12′ on the next superjacent or subjacent panel 4, so that the panels can be folded accordion-style into full contact, overlapping relationship (FIG. 1). By "reversed" in this case is meant that one set of lugs 10 or 12 extends outwardly and towards the front or rear of the panel 4 (in the erect position of the ladder), and the other set of lugs 10″ or 12″ extends in the opposite direction on the superjacent or subjacent panel 4.

Figure 1:
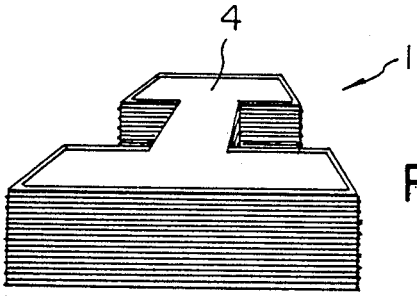
FIG. 1 is a schematic, perspective view from above and one side of a collapsible ladder in accordance with the present invention.

The lugs 13 are generally C-shaped and alternate, i.e. alternately open towards the front or rear of the panel 4 (in the erect position of the ladder) for receiving hinge pins (not shown) for pivotally connecting the sides 9 of the panel 4 to rectangular panels 15. The lugs 13 overlap with similar lugs 17 on the panels 15. In cooperation with the sides 9 of the panels 4, the panels 15 define the ladder side bars 2. The panel 15 is defined by a planar, rectangular body 18, with the lugs 17 on each side thereof, and lugs 19 and 20 on the ends thereof. The lugs 17 are similar to the lugs 13, i.e. generally C-shaped, and the lugs 19 and 20 are similar in terms of shape and size to the lugs 10 or 12. Moreover, the lugs 19 are reversed with respect to the lugs 20 in the same manner as the lugs 10 and 12. The lugs 19 alternate with the lugs 20 for connecting the panels 15 together in end-to-end relationship. The lugs 17 are opposite to each other. When forming the side bars 2 of the ladder, the panels 25 of the second or outer row of panels 15 are reversed with respect to the panels 15 of the first or inner row, so that the lugs 17 of one panel overlap the lugs 17 of the other panel 15.

Figure 11:
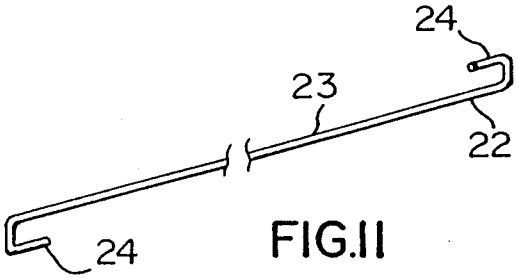
FIG. 11, which appears on the third sheet of drawings with FIG. 5, is a perspective view of a torsion spring used in the ladder of FIGS. 1 to 3.
Figure 6:
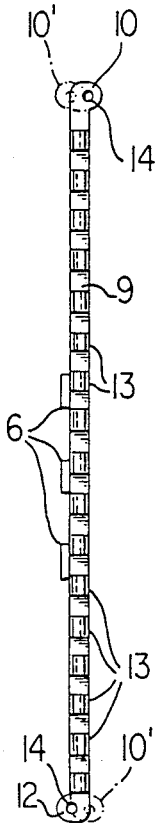
FIG. 6 is a side view of the panel of FIG. 4.
Figure 7:
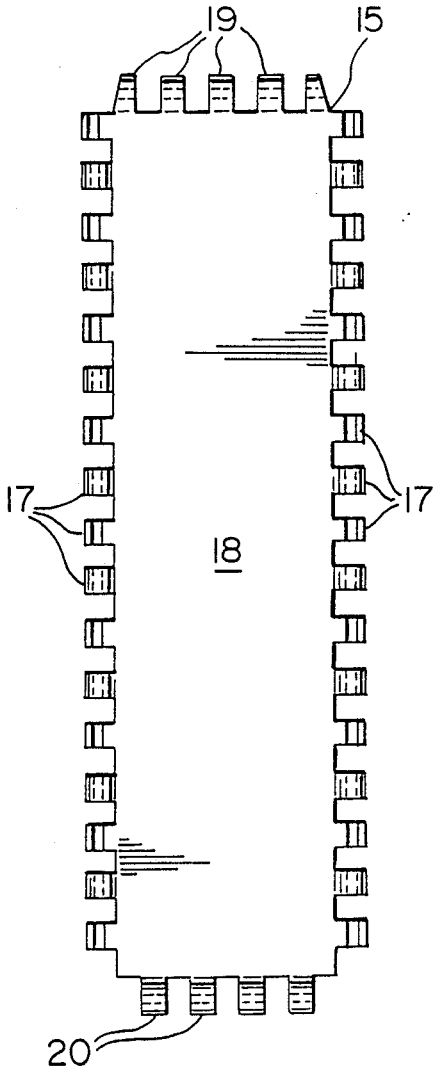
FIG. 7 is a plan view of a second panel used in the ladder of FIGS. 1 to 3.
Figure 8:
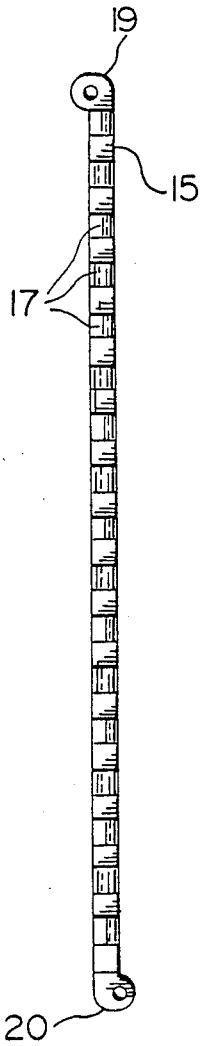
FIG. 8 is a side view of the panel of FIG. 7.
Figure 9:
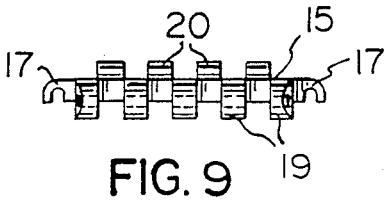
FIG. 9 is an end view of the panel of FIG. 7.
Figure 10:
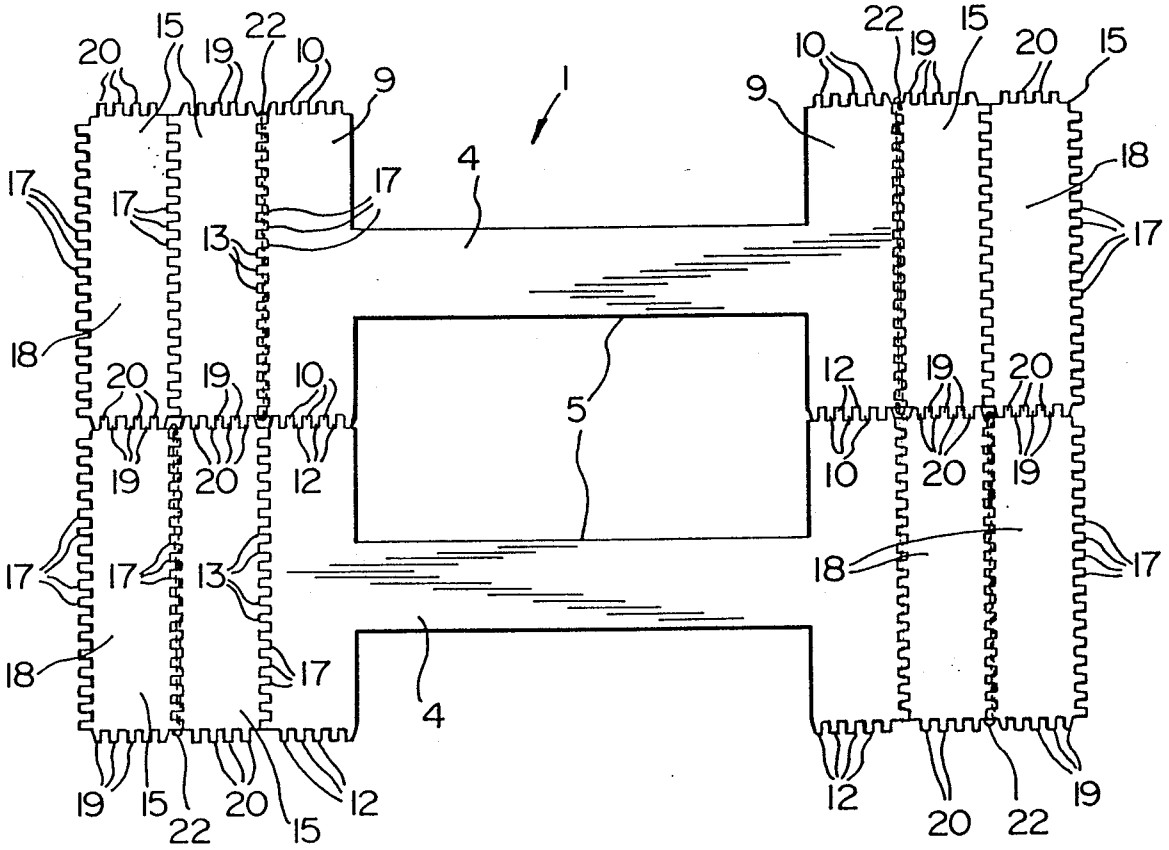
FIG. 10 is a schematic plan view of the panels of FIGS. 4 to 6 and to 9 interconnected to form a ladder section.

A torsion spring 22 (FIGS. 10 and 11) is defined by a rod 23 with hook ends 24. The spring 22 replaces the hinge pin between adjacent panels 4 and 15 or between two panels 15. A spring 22 can be provided at each joint between a panel 6 and a panel 15 or between each adjacent pair of panels 15. However, a spring at alternate connections along the length of the ladder will perform the required task of causing the panels to snap into the ladder or use position as soon as the sections have been completely unfolded to the flat condition.

Figure 2:
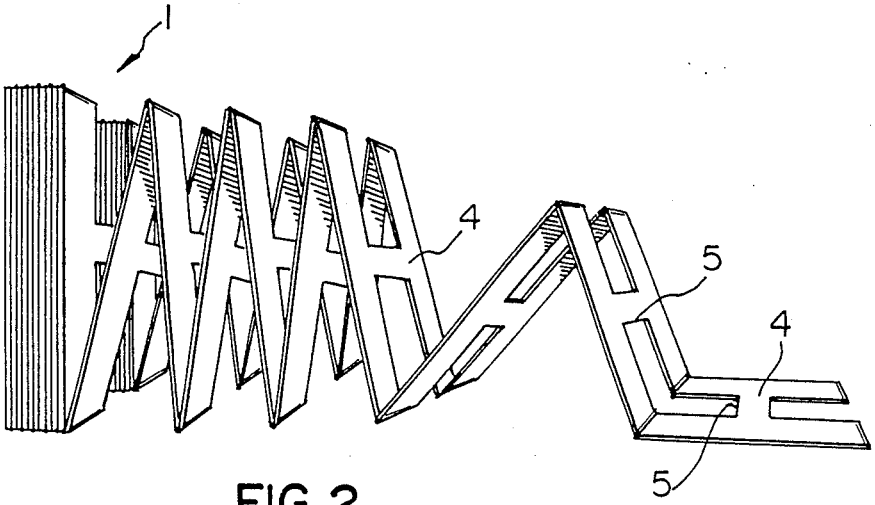
FIG. 2 is a schematic, perspective view of the ladder of FIG. 1 in the partly extended condition.
Figure 3:
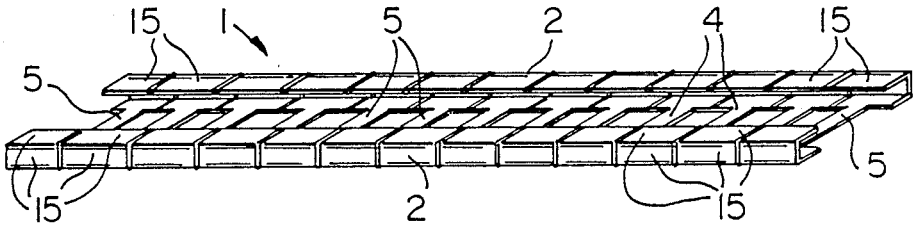
FIG. 3 is a schematic, perspective view of the ladder of FIGS. 1 and 2 in the fully extended, use position.
Figure 4:
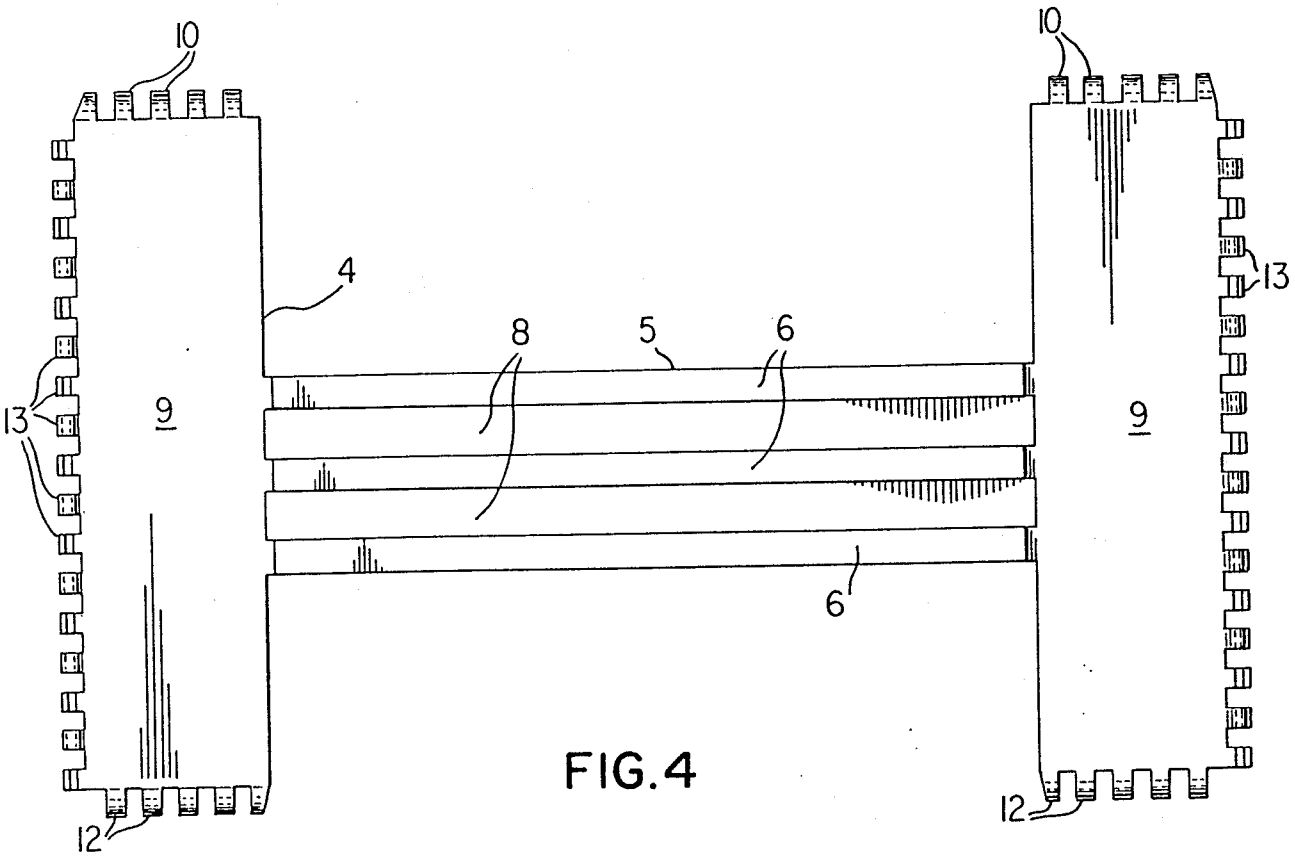
FIG. 4 is a bottom, elevational view of a panel used in the ladder of FIGS. 1 to 3.
Figure 5:
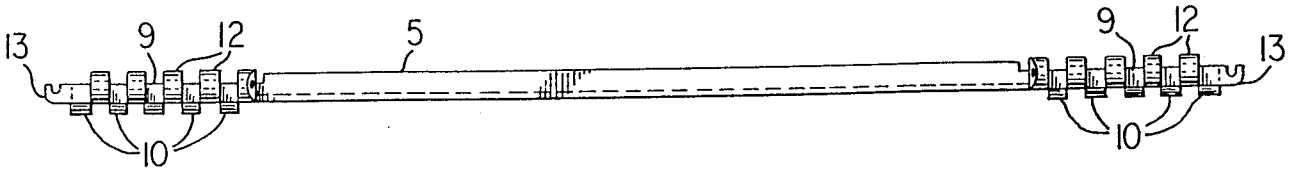
FIG. 5 is an end view of the panel of FIG. 4.

In use, the ladder is stored in the completely folded condition (FIG. 1), forming a tidy, compact bundle. When aluminum is used to form the panels 4 and 15, the ladder is relatively lightweight and easy to carry. In order to use the ladder, sections 1 thereof are unfolded (FIG. 2) until the entire assembly is flat on the floor or other surface. As soon as the last section 1 has been unfolded, the torsion springs 22 cause the panels 15 to rotate around the sides 9 of the panel 4 to define the ladder side bars 2 (FIG. 3). It is easy to force the sections 1 to the flat condition manually for refolding of the ladder to the storage condition.

It is readily apparent that the simplest form of the ladder includes fixed rung sections or panels 4 with lugs on the outer side, top and bottom edges thereof for pivotally interconnecting the rung panels to each other and to at least one set of side bar panels at each end of the rung panels. In the use position, the resulting ladder would have L-shaped sides, and would still function as a ladder. Admittedly, greater strength is achieved by having side bars of U-shaped cross section. In fact, ladders formed in the manner described hereinbefore, i.e including sections 1 defined by a panel 4 and a pair of panels 15 on each side thereof are surprisingly strong in the use condition and can take a heavy load when laid horizontally between two end supports. Typical overall dimensions for the panels 4 are a length or height of cm and a width of 47.6 cm. Lightweight material such as aluminum can be used to fabricate each of the elements of the invention, except for the torsion spring 22.

Thus, there has been described a relatively simple, lightweight collapsible ladder, which can readily be unfolded to a flat condition. Once collapsed to a flat condition, the sides of the ladder automatically pivot to form U-shaped side bars. A nylon belt or rope can be provided between such side bars for ensuring that the side bars remain in the folded, use position. In order to collapse the ladder, the side bars are folded outwardly to the flat condition against the bias of the torsion springs and the sections are refolded to the collapsed condition.

What is claimed is:

1. A collapsible ladder comprising a plurality of panel means pivotally interconnected in end-to-end relationship to form a compact body when folded into overlapping relationship with each other and to define an elongated body when unfolded so that the panel means are end- to-end in a plane, each said panel means including substantially rigid, central, transversely extending rung means and at least one side bar means on each end of said rung means pivotally connected to said rung means and to any subjacent or superjacent side bar means for rotation between a storage position in the same plane as said rung means and a use position perpendicular to said rung means; and spring means for biasing at least one and consequently all other said side bar means to the use position, whereby, when the said panel means are unfolded, the side bar means automatically rotate to the use position.

2. A ladder according to claim 1, wherein said panel means is generally H-shaped, and said side bar means are pivotally connected to the vertical sides of the H.

3. A ladder according to claim 1, wherein said side bar means includes two longitudinally extending, pivotally interconnected sections for pivotal interconnection to any similar subjacent or superjacent sections, whereby, when the panel means are unfolded to the use position, said side bar means fold to define a ladder side bar of generally U-shaped cross-sectional configuration.

4. A ladder according to claim 1, 2 or 3, wherein said spring means includes rod means defining a hinge pin between at least some adjacent panel means and side bar means; end hook means on the ends of said rod means for biasing said side bar means to the use position.

5. A collapsible ladder comprising a plurality of first, generally H-shaped panel means, each said first panel means including substantially rigid, transversely extending rung means and longitudinally extending sides integral with said rung means and pivotally interconnected in end-to-end relationship to the sides of other first panel means to form a compact body when the first panel means are folded into overlapping relationship with each other and to define an elongated body when said first panel means are unfolded so that such first panel means are end-to-end in a plane; side bar means including a pair of second panel means on each side of said first panel means pivotally connected to said first panel means and to each other, the second panel means of each side bar means being pivotally connected in end-to-end relationship to any subjacent or superjacent second panel means for rotation with said first panel means between the storage and use positions; and spring means for biasing said second panel means to a use position, whereby, when said first panel means are unfolded, the second panel means automatically rotate to define generally U-shaped ladder side bars with the sides of said first panel means.

6. A ladder according to claim 5, wherein said spring means includes rod means defining a hinge pin between at least some adjacent first and second panel means; and hook means on said rod means for biasing said second panel means to the use position.

* * * * *